US005919297A

United States Patent [19]

Chavannes

[11] Patent Number: 5,919,297

[45] Date of Patent: Jul. 6, 1999

[54] COBALT- AND NICKEL-FREE SEALANT COMPOSITIONS

[75] Inventor: Jean Pierre Chavannes, St.-Louis, France

[73] Assignee: Clariant Finance (BVI) Limited, Tortola, Virgin Islands (Br.)

[21] Appl. No.: 08/878,893

[22] Filed: Jun. 19, 1997

[30] Foreign Application Priority Data

Jun. 20, 1996 [GB] United Kingdom ..... 9612924

[51] Int. Cl.[6] ..... C09K 15/12

[52] U.S. Cl. ..... 106/287.23; 106/14.13; 106/287.2; 106/287.26; 148/271; 148/272; 427/430.1

[58] Field of Search ..... 148/271, 272; 427/430.1; 106/14.13, 287.2, 287.23, 287.26

[56] References Cited

U.S. PATENT DOCUMENTS

| | | | |
|---|---|---|---|
| 4,588,488 | 5/1986 | Baumann et al. | 148/6.27 |
| 5,362,317 | 11/1994 | Patel et al. | 106/287.23 |
| 5,374,455 | 12/1994 | Patel et al. | 427/435 |
| 5,411,607 | 5/1995 | Basaly et al. | 148/272 |
| 5,478,415 | 12/1995 | Massad et al. | 148/272 |

FOREIGN PATENT DOCUMENTS 2 2546 22 10/1992 United Kingdom .

*Primary Examiner*—David Brunsman
*Attorney, Agent, or Firm*—Susan S. Jackson

[57] ABSTRACT

Aluminium oxide sealant compositions, concentrates, and processes employing the same are described which comprise a combination of certain sulphonated aromatic compounds and condensates of aldehydes and certain other sulphonated aromatic compounds. Unexpected improvements in seal quality are obtained using the compositions of the invention, and in the substantial absence of smut formation.

11 Claims, No Drawings

COBALT- AND NICKEL-FREE SEALANT COMPOSITIONS

The invention relates to sealant compositions and their use in treatments of aluminium oxide films. In particular, the invention relates to compositions which provide an effective seal of aluminium and which also prevent or minimize formation of smut deposits during sealing; to concentrates for preparing the sealant compositions; and to sealing processes employing the same.

Aluminium or aluminium alloy is often surface treated to improve its hardness and resistance to corrosion, as well as to provide a substrate for depositing organic dyes or inorganic metal salts. Such treatments generally involve laying down a porous film or coating of adherent aluminium oxide on the aluminium surface, typically by direct current anodising of the aluminium in an aqueous strong acid electrolyte. However, the aluminium oxide films because of their porosity remain somewhat vulnerable to corrosion, leaching of colorant or other deterioration; and in general must be sealed or the pores otherwise protected, for the films to be completely useful, particularly if employed, for example, in architectural uses.

Sealing of aluminium oxide film has traditionally been carried out as a hydrothermal process in which the porous, essentially anhydrous aluminium oxide film is immersed in an aqueous bath maintained at a temperature at or near the boiling point, to result in the formation of hydrated aluminium oxide compounds such as boehmite. The formed hydrated compounds are believed to cause a constriction or blockage of the pores of the aluminium oxide film, producing the observed sealant effect.

Demineralised water at or near the boiling point has been used to make up sealing baths. Acceptable seal quality has also been obtained from ordinary tap water baths and at somewhat reduced temperatures, e.g., about 70–90° C., by the addition of various additives to the bath, in particular, soluble salts of divalent metals, especially cobalt or nickel acetate.

However, a recognized limitation associated with aqueous sealant compositions or water per se as steam or hot water to seal anodised aluminium is the tendency for residual hydrated aluminium oxide crystals to deposit as smut (or bloom) on the aluminium oxide surface, often seriously detracting from its appearance. Chemical and mechanical de-smutting after-treatments introduce an added expense and may themselves adversely affect seal quality.

A particular aspect in this technology is represented by the use of smut-inhibiting sealant additives in the sealing baths. For various reasons (in particular economy in procedure and employed products, process-yield and backwater volume) it is furthermore desired to use a sealing bath more than once, i.e. to carry out more than one sealing runs in one bath. In this the composition and efficiency of the sealing bath is periodically checked. When the efficiency of the bath has reduced below the aimed effect, it may be increased somewhat again by reinforcing it by addition of further sealant additive; after a certain number of such additions, however, their effect diminishes or is superated by the negative concentration effect, and thus a fresh bath is required. Furthermore it is desired to work at a temperature well below the boil, in particular for economical reasons and also in order to avoid any inconvenients accompaning the working at or near the boil.

In U.S. Pat. No. 5,411,607 and in GB-A 2254622 there is described, as smut inhibiting products, compounds having the following formula (I)

(I)

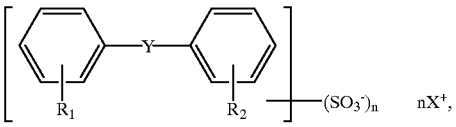

in which

Y is a direct bond or is selected from the group consisting of —O—, —S—, —$C(CH_3)_2$—, —SO— or —$SO_2$—;

each of $R_1$ and $R_2$ is independently hydrogen or $C_5$–$C_{25}$alkyl, with the proviso that $R_1$ and $R_2$ are not both hydrogen;

n is an integer from 1 to 4, inclusive;

and $X^+$ is a counterion, such as $H^+$ or an alkali metal ion, which according to GB-A 2254622 are employed in combination with certain soluble alkaline earth metal salts and according to U.S. Pat. No. 5,411,607 are employed together with a source of lithium ions.

In U.S. Pat. No. 4,588,448 there are described as smut inhibiting sealant additives, in particular in combination with nickel acetate, condensation products of an aldehyde and a compound of formula (II) or (III)

(II)

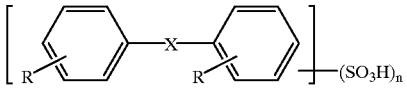

(III)

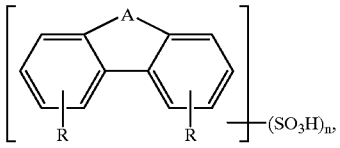

in which

X is a direct bond, —$C(CH_3)_2$—, —O—, —S—, —SO— or —$SO_2^-$;

A is —O— or —S—;

each

R independently, is hydrogen, $C_{1-4}$alkyl, hydroxy or halogen;

and n is 1 to 4.

In EP-A 0122129 there are described as smut-inhibiting sealant additives, among many other smut-inhibitors, condensation products of formaldehyde with compounds of formula (II) above.

In the comparative Examples of U.S. Pat. No. 5,411,607 (Solutions I, J, L and M, and Solutions 1 and 2 of Comparative Example 2), which are carried out at 185 or 190° F. (=85 or 87.78° C. respectively) the compared solutions of compounds of formula (I) are shown to be of low efficiency if they are not employed together with lithium acetate, while at temperatures below 185° F. (i.e. below 85° C.) the acid dissolution test (ADT) shows in Example 2 of U.S. 5,411,607 a worsening even in the presence of lithium acetate.

Condensates of an aldehyde and a compound of formula (II) above as described in U.S. Pat. No. 4,588,448 or EP-A 0122129 employed at or near the boil are shown in Example 6 of EP-A 0122129 to give acid loss values (according to the standard test method ISO 3210—1974 or ASTM B 680-80—1989) ranging from 19 to 38 mg/dm$^2$ [where 38 mg/dm$^2$ is well above the "adequate" rating of up to 30 mg/dm$^2$ stated in the same document at page 5 and near the "failure" range of >2.6 mg/in$^2$ (i.e. >40.3 mg/dm$^2$) stated in U.S. Pat. No. 5,411,607]. If these condensates are employed at lower temperatures their efficiency worsens distinctly.

It has now surprisingly been found that the combination of compounds of formula (I) in the form of soluble salts of monovalent metals, especially alkali metal salts, and/or ammonium salts, and condensates of aldehydes with compounds of formula (II), preferably also in the form of soluble salts of monovalent metals, especially alkali metal salts, and/or ammonium salts, are not only very efficient first bath smut inhibiting sealant additives, even at temperatures below the boil and even below 90 or 85° C., in particular in the range of 80° C. to 85° C., especially at 82° C., but are also of unexpectedly high yield, i.e. they substantially maintain their efficiency if the sealing bath is used repeatedly for several times. These combinations are in particular excellent smut-inhibiting additives for sealant compositions without the need of adding cobalt, nickel or magnesium acetate, and they are also very efficient in the form of their sodium salts, even without any addition of lithium ions.

According to the invention, there are provided novel aqueous sealant compositions and concentrates which comprise (a) at least one compound of formula (Ia)

(Ia)

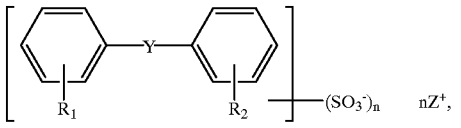

in which

Y is a direct bond or a bridging atom or group of formula —O—, —S—, —C(CH$_3$)$_2$—, —SO— or —SO$_2$—;

each of $R_1$ and $R_2$ is independently hydrogen or $C_5$–$C_{25}$-alkyl, with the proviso that $R_1$ and $R_2$ are not both hydrogen;

n is 1 to 4, inclusive;

and $Z^+$ is a monovalent counterion, such as $H^+$ and/or an alkali metal ion and/or ammonium, and (b) a condensation product of an aldehyde and at least one compound having the following formula (IIb) or (IIIb)

(IIb)

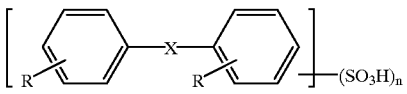

-continued (IIIb)

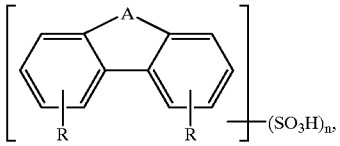

in which

X is a direct bond, —C(CH$_3$)$_2$—, —O—, —S—, —SO— or —SO$_2$—;

A is —O— or —S—;

each

R independently, is hydrogen, $C_{1-4}$-alkyl, hydroxy or halogen;

and n is 1 to 4.

In a formula, where a symbol appears more than once, its significances can be the same or different, preferably the same.

By halogen is meant chlorine or bromine, preferably chlorine.

Preferably, in formula (Ia) one of the substituents $R_1$ and $R_2$ is hydrogen and the other is $C_{5-25}$-alkyl, more preferably $C_{10-18}$-alkyl, most preferably $C_{12-16}$-alkyl. If $R_2$ is not hydrogen, it has preferably the same as $R_1$.

Preferably Y is Y' where Y' is a direct bond or —O—.

In formula (Ia) n, which may be an integer or also a non-integral average, is preferably 1–2, more preferably 2.

Particularly preferred compounds of formula (Ia) are of formula (Ia')

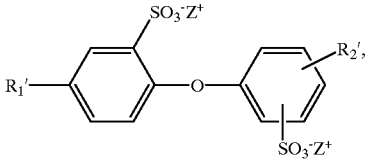

in which $R_1'$ is linear $C_{12}$- or $C_{16}$-alkyl, $R_2'$ is hydrogen or has the same significance as $R_1'$ (i.e. linear $C_{12}$- or $C_{16}$-alkyl) which alkyl group is in para position to —O—, and —SO$_3^-$Z$^+$ is in ortho position to —O— or, if $R_2'$ is hydrogen, the group —SO$_3^-$Z$^+$ may also be in para position to —O—.

Preferably, in formula (IIb) and (IIIb) R is R' where each R' independently is hydrogen, methyl or hydroxy, preferably hydrogen or more preferably methyl. The methyl groups are preferably in para position and/or more preferably in ortho position to —O—.

Preferably X is X' where X' is a direct bond or —O—.

Preferably A is —O—.

In formula (IIb) or (IIIb) n, which may be a non-integral average, is preferably n' where n' is 1–2.

More preferred sulphonated aromatic compounds according to formulae (IIb) or (IIIb) are sulphonation products or diphenyl, phenyltoluene, dimethyldiphenyl, diphenylether, diphenylsulphide, diphenylsulphoxide, dihydroxydiphenylsulphone, diphenylene oxide, diphenylene sulphide.

More preferred sulphonated aromatic compounds are sulphonated diphenyl, dimethyldiphenyl, diphenylether and ditolylether.

Preferred aldehydes used in the preparation of the reaction product are acetaldehyde and formaldehyde, more preferably formaldehyde.

Preferred reaction products are those formed by the reaction of formaldehyde with a compound of formula (IIb) or (IIIb) containing no halogen or hydroxyl groups. More preferred is the reaction product of formaldehyde with a compound of formula (IIb')

(IIb')

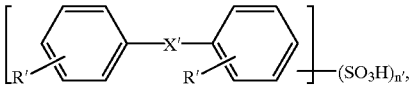

in which R', X' and n' are as defined above.

They may be synthetised analogously as described in U.S. Pat. No. 4,588,448.

Preferably the reaction products used in the process of the invention are light fast compounds. By the term "light fast" is meant that when the reaction product is applied to an anodically oxidized uncoloured aluminium piece in a sealing bath of hot water, the reaction product and a trace of acetic acid to bring the pH of the bath to 5.5 to 6 for a time period of 1–3 minutes per $\mu$m of oxide layer on the surface of the aluminium piece, the reaction product shows no significant yellowing after exposure to sunlight for 24, preferably 48 hours.

The compositions according to the invention provide high quality seal of clear or dyed aluminium oxide films and have anti-smutting (i.e. smut inhibiting) properties. They are free of added nickel or cobalt salts and therefore are less objectionable from an environmental standpoint. Furthermore, the compositions of the invention may be prepared from tap water and may be satisfactorily employed for sealing at temperatures below the boiling point.

Advantageously, sealant concentrates according to the invention can be diluted to form sealing bath solutions, and when the molar ratios of the components are adjusted to be within the indicated range, the sealing solutions are substantially free from the cloudiness which has been observed in connection with certain prior art compositions when diluted from the concentrate into sealing baths.

The aluminium oxide films which are to be sealed employing the compositions and process of the invention may be prepared in various ways. Conventionally, the aluminium is anodised by passing direct current to the aluminium workpiece as the anode in an aqueous acidic electrolyte. Sulphuric acid is typically the preferred electrolyte to provide anodic oxide coating of suitable thickness, corrosion resistance and adaptability for colouring, for most commercial applications. In order to fully benefit from the smut-inhibiting characteristic of the compositions of the invention, anodising should preferably be carried out at about 1.3 to 2.7 A/dm$^2$ within a temperature range of about 17 to 21° C. in a 15 to 22% by weight sulphuric acid electrolyte.

Compounds of formulae (Ia), (IIb) or (IIIb), in particular components (a) or (b) are known per se or/and can be prepared from known materials by analogy with established procedures. They have surfactant properties and some are commercially available, e.g. as a formulation which may comprise a mixture of such components (a) or (b), particularly a component (a) mixture of mono-alkylated (i.e. where one of $R_1$ and $R_2$ is hydrogen) and di-alkylated (i.e. where neither $R_1$ nor $R_2$ is hydrogen) compounds of formula (Ia), or a component (b) mixture in which the two symbols R in formula (IIb) or (IIIb) have the same and different significances and/or, if the two symbols R have the same significance, they may be in different positions, so that compounds (Iib) or (IIIb) mixtures of positional isomers.

Therefore, a compound of formulae (Ia), (IIb) or (IIIb) shall be understood to include single compounds or also mixtures of compounds having the above-described formulae (Ia), (IIb) or (IIIb), particularly also mixtures of mono- and di-alkylated compounds and/or of positional isomers.

Any alkyl may be linear or branched unless indicated to the contrary.

In the abovementioned preferred compounds, $Z^+$ is preferably $Na^+$.

Components (a), i.e. compounds of formula (Ia), are generally available in form of aqueous solutions of their sodium salts, but may also be provided to the sealant composition in free acid and/or other salt form (in particular other alkali metal salt form and/or ammonium salt form). Aqueous solutions have, in general, a content of active substance of about 30–70% by weight.

In the compositions according to the invention the molar ratio (calculated as active substance) of component (a) to component (b) [indicated as molar ratio of compounds of formula (Ia) to compounds of formula (IIb) and (IIIb)] is preferably about 1:10 to about 5:1, more preferably 1:4 to 4:1, and most preferably about 1:1 to 2:1.

The weight ratio of component (a) to component (b) is advantageously $\leqq$10/1, preferably in the range of 0.15:1 to 10:1, more preferably in the range of 0.7/1 to 4.5:1, most preferably in the range of 1/1 to 2/1.

The total combined concentration in the sealing composition of component (a) [i.e. the compound of formula (Ia)] and component (b) can be about 0.1 to 2.5 g/l and is preferably about 0.2 to 1 g/l, although higher concentrations may be employed as needed to produce the desired sealant effect, e.g. when reinforcing additions are supplied to the sealing bath as required, if several sealing runs are carried out in one sealing bath.

The sealant compositions of the invention may be formed by dissolving Components (a) and (b) in demineralised water or in tap water. For convenience, a sealant concentrate may first be formed which comprises a concentrated aqueous solution (e.g. having a water content about in the range of 30 to 80%) of the Components (a) and (b) and any optional further components; and the concentrate may then be diluted into an aqueous sealant bath to form a sealant composition of the invention. For example, compounds of formula (Ia) are generally available as aqueous solutions thereof (e.g., an aqueous 35–70% solution of the compounds), and concentrates according to the invention may thus, e.g., be formed by simply adding component (b) to such a Component (a) solution. Suitable aqueous concentrates preferably contain $\geqq$12% by weight of the combined Components (a) and (b), in particular 120–500 g/l of the combined Components (a) and (b), most preferably 15–40% by weight thereof, e.g. a suitable aqueous concentrate contains 120 to 450 g/l of the combination. The (a)-content is preferably in the range of 2.8 to 28% by weight, more preferably 7 to 14% by weight; the (b) content is preferably in the range of 2.8 to 17% by weight, more preferably 2.8 to 10% by weight. The concentrates are believed to be novel and comprise another aspect of the invention. The pH of the concentrates may range preferably between 4.0 and 8.0, more preferably between 4.5 and 6.5, most preferably in the range of 5 and 6.5.

The sealant compositions per se may be formulated within a broad pH range such as may facilitate handling, and the compositions when employed for sealing are maintained at a pH sufficiently high to promote effective sealing but below a value at which results in substantial smut formation and/or precipitation of the components of the sealing composition. Usually, the pH will range from between about 4.0 to 8.0, more usually 4.5 to 6.5, preferably 5.5 to 6.5 more preferably 5.5 to 6. The pH may be adjusted by adding acetic acid and/or ammonia to make the bath more acid or alkaline. An advantage of the invention is that the pH of the sealant composition can be readily made stable over an extended period of time, and consequently frequent readjustment of pH is generally not required.

The sealant bath may contain other conventional additives such as, e.g., wetting agents, buffering agents, defoaming agents, etc.

By employing the aqueous compositions of the invention, it is possible to obtain high quality seal at temperatures at or in particular well below the boiling point, i.e. in a range of about 75° C. to 100° C. and preferably about 80° C. to 90° C.

The aluminium oxide surface is immersed in the sealant bath for a suitable length of time to accomplish the sealing, depending on the thickness of the oxide film.

The process parameters for sealing are mutually dependent, in that a shortened immersion time will generally require an elevation of temperature and/or higher pH. A conventional water rinse is employed after sealing to remove any chemical residue and to facilitate drying.

The sealing process according to the invention can be employed in connection with both clear and coloured anodised aluminium as well as in batch or continuous operations.

The term "aluminium" as used herein shall be understood to include pure aluminium as well as aluminium base alloys containing at least 50% by weight aluminium. The aluminium surface can be of any desired shape or form suitable for the oxidising and sealing operations contemplated by the invention, including extruded, drawn, machined or rolled shapes and forms.

By the following examples the invention will be illustrated, however, they do not present any limitation of the invention.

EXAMPLES

Aluminium (Peraluman 101) coupons measuring 5.1 cm×7.6 cm are degreased, etched with an alkaline cleaner and washed, then anodically oxidised at 1.62 A/dm$^2$ in an aqueous 18% weight sulphuric acid bath at 20–21° C. for 35 minutes, resulting in an anodic oxide layer of about 20 $\mu$m, and therafter are rinsed with demineralised water. The coupons are then immersed for 15 minutes in a demineralised water sealant bath at pH 5.7 and 82° C. Subsequently, they are removed from the bath and rinsed with tap water and dried.

The following Tables contain specific examples of smut inhibiting sealant additives as concentrated compositions, varying in the concentrations and ratios of Components (a) and (b) and in the pH, which is adjusted with glacial acetic acid and ammoniac (an aqueous, about 25 weight-% ammonia solution). In these examples, the concentrates contain as Component (a) a compound of formula (Ia') (referred to as Product A) and as Component (b) a condensation product of formaldehyde and a compound of formula (IIb') (referred to as Product B) in the respective concentrations (percentage by weight) listed in the Tables. The exemplified concentrates are added to the sealant bath in a concentration of 2 g/l and if the same bath is used on for further sealing until its efficiency diminishes below a certain degree of anti-smutting efficiency, it is reinforced at this point by addition of 1 g/l of the same concentrate. The aqueous sealant baths contain the Components (a) and (b) in corresponding concentrations.

Component (a) is provided as an aqueous solution of compounds having the following formula:

(Ia″)

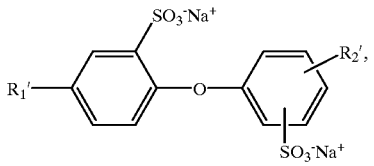

in which $R_1'$ is linear $C_{12}$- or $C_{16}$-alkyl, $R_2'$ is hydrogen or has the same significance as $R_1'$ (i.e. linear $C_{12}$- or $C_{16}$-alkyl) which alkyl group is in para position to —O—, and —$SO_3^-Na^+$ is in ortho position to —O—, or, if $R_2'$ is hydrogen, the group —$SO_3^-Na^+$ may also be in para position to —O—.

More particularly, Component (a) used in the examples comprises a mixture of mono-alkylated (i.e. where $R_2'$ is hydrogen) and di-alkylated (i.e. where both $R_1'$ and $R_2'$ are $C_{12}$- or $C_{16}$-alkyl) compounds in a weight percent ratio of about 80:20. Component (b) is provided as 100% active substance of a condensation product of formaldehyde with sulphonated ditolylether, produced e.g. as described in U.S. Pat. No. 4,588,448.

Table 1 contains concentrated compositions of the invention. Table 2 contains concentrated compositions containing either Components (a) or Components (b) of the state of the art. Tables 3–8 contain test results for anti-smutting efficiency, sealing quality and sealing bath yield.

The aluminium strips obtained in examples 1–12 give high quality seal in high yield, as may be determined by visual inspection and by measuring the acid weight loss.

TABLE 1

| Example | 1 | 2 | 3 | 4 | 5 | 6 | 7 | 8 | 9 | 10 | 11 | 12 |
|---|---|---|---|---|---|---|---|---|---|---|---|---|
| Product A | 36.0 | 30.0 | 20.0 | 15.0 | 10.0 | 8.0 | 20.0 | 25.0 | 25.0 | 25.0 | 40.0 | 40,0 |
| Product B | 3.0 | 5.0 | 10.0 | 12.0 | 15.0 | 17.0 | 5.0 | 5.0 | 5.0 | 5.0 | 3.0 | 2.8 |
| acetic acid | 7.8 | 7.8 | 7.8 | 7.8 | 7.8 | 7.8 | 7.8 | 7.8 | 7.8 | 7.8 | 7.8 | 7.8 |
| ammoniac | 11.8 | 11.5 | 11.5 | 12.5 | 12.6 | 12.5 | 12.6 | 12.6 | 10.9 | 9.4 | 11.8 | 19.2 |
| water | 41.6 | 45.7 | 50.7 | 52.7 | 54.6 | 54.7 | 54.6 | 49.6 | 51.3 | 52.8 | 37,4 | 30.2 |

TABLE 1-continued

| Example | 1 | 2 | 3 | 4 | 5 | 6 | 7 | 8 | 9 | 10 | 11 | 12 |
|---|---|---|---|---|---|---|---|---|---|---|---|---|
| total | 100.0 | 100.0 | 100.0 | 100.0 | 100.0 | 100.0 | 100.0 | 100.0 | 100.0 | 100.0 | 100.0 | 100.0 |
| pH | 6.0 | 6.0 | 6.0 | 5.9 | 5.9 | 5.9 | 5.9 | 5.9 | 5.7 | 5.5 | 6.4 | 6.4 |

In Examples 1 to 11 $R_1'$ is linear $C_{16}$-alkyl and the stated quantities refer to a 35% solution.
In Example 12 $R_1'$ is linear $C_{12}$-alkyl and the stated quantity refers to a 70% solution.

TABLE 2

| | Comparative Examples | | | | | | |
|---|---|---|---|---|---|---|---|
| Example | 13 | 14 | 15 | 16 | 17 | 18 | 19 |
| Product A | 50.0 | 44.0 | 20.0 | 40.0 | 40.0 | — | — |
| Product B | — | — | — | — | — | 5.0 | 50 |
| acetic acid | 7.8 | 7.8 | 7.8 | 7.8 | 7.8 | 7.8 | 7.8 |
| ammoniac | 11.0 | 12.0 | 12.7 | 12.4 | 19.2 | 10.9 | 10.9 |
| water | 31.2 | 36.2 | 59.5 | 39.8 | 33.0 | 76.3 | 31.3 |
| total | 100.0 | 100.0 | 100.0 | 100.0 | 100.0 | 100.0 | 100.0 |
| pH | 6.4 | 6.0 | 5.9 | 6.4 | 6.4 | 5.7 | 5.7 |

In Examples 13 to 16, 18 and 19 $R_1'$ is linear $C_{16}$-alkyl and the stated quantities refer to a 35% solution.
In Example 17 $R_1'$ is linear $C_{12}$-alkyl and the stated quantities refer to a 70% solution.

The following Tables 3 to 8 contain the results of visual determination of smutting, by comparison with standard samples in a 5-degree scale (degree 1=practically no smutting, degree 5=completely smutted) and the quality of sealing as determined according to standard test method ISO 3210-1983. The sealings are carried our by more consecutive sealing runs in one same bath for each example, the first bath sealing being the sealing of 2 $dm^2$ of the aluminium oxide layer, the second being the sealing of +3 $dm^2$ in the same bath (i.e. 5 $dm^2$ in all), the third being the sealing of +5 $dm^2$ in the same bath (i.e. 10 $dm^2$ in all), and so on as indicated in the tables. Where visual assessment of smutting exceeded degree 3 of the standard, the sealing bath was then reinforced by addition of 1 g/l of the same concentrate sealant composition; this point is indicated in the following tables by an asterisk *. For comparative examples 18 and 19 the first ISO 3210-1983 test indicated such a high acid weight loss that the test series was not continued.

TABLE 3

| $dm^2$ | property | Ex. 14 | Ex. 1 | Ex. 2 | Ex. 3 |
|---|---|---|---|---|---|
| 2 | smut | 1–2 | 1–2 | 1–2 | 1–2 |
| | acid weight loss | 5.1 | 4 | 3.6 | 3.2 |
| 5 | smut | 1–2 | 1–2 | 1–2 | 1–2 |
| | acid weight loss | 5.6 | 3.6 | 4 | 3.2 |
| 10 | smut | 1–2 | 1–2 | 1–2 | 1–2 |
| | acid weight loss | 4.5 | 3.3 | 3 | 3.2 |
| 15 | smut | 1–2 | 1–2 | 1–2 | 1–2 |
| | acid weight loss | 4.3 | 3.3 | 2.8 | 3.9 |
| 20 | smut | 1–2 | 2 | (1)–2 | 2–(3) |
| | acid weight loss | 6.2 | 4.8 | 4.4 | 4.7 |
| 25 | smut | (1)–2 | 2 | 2–(3) | 2 |
| | acid weight loss | 5.9 | 5 | 4.3 | 5.6 |
| 30 | smut | 2–3 | 2–3 | 2–(3) | 2–3 |
| | acid weight loss | 4 | 3.6 | 3.7 | 4.6 |
| 35 | smut | 3* | 3* | 3* | 3* |
| | acid weight loss | 4.3 | 4.9 | 4.8 | 2.7 |

The seal quality (first bath and average) achieved with Examples 1, 2 and 3 is higher than the one achieved with comparative example 14.

TABLE 4

| $dm^2$ | property | Ex. 15 | Ex. 4 | Ex. 5 | Ex. 6 |
|---|---|---|---|---|---|
| 2 | smut | 2 | 1–2 | 1–2 | 1–2 |
| | acid weight loss | 2.9 | 1.9 | 1.8 | 1.4 |
| 5 | smut | 2–(3) | 1–2 | 1–2 | 1–2 |
| | acid weight loss | 4 | 2 | 1.1 | 1.3 |
| 10 | smut | 1–2 | 1–2 | 1–2 | 1–2 |
| | acid weight loss | 3.3 | 2.6 | 2.4 | 3.2 |
| 15 | smut | 3* | 2 | 2–(3) | 2 |
| | acid weight loss | 3.6 | 3.7 | 3.3 | 4.7 |

For the composition of Example 15 a reinforcing addition is already necessary after 15 $dm^2$. The seal quality (first bath and average) obtained with the compositions of Examples 4, 5 and 6 is higher than the one obtained with the composition of example 15.

TABLE 5

| $dm^2$ | property | Ex. 18 | Ex. 19 |
|---|---|---|---|
| 2 | acid weight loss | 23.4 | 44.9 |

The seal quality achieved already in the first bath with the compositions of examples 18 and 19 is so low that the test series was not carried on.

TABLE 6

| $dm^2$ | property | Ex. 7 | Ex. 8 | Ex. 9 | Ex. 10 |
|---|---|---|---|---|---|
| 2 | smut | 2 | 1–2 | 1–2 | 1–2 |
| | acid weight loss | 3.9 | 4.3 | 4.1 | 4.1 |
| 5 | smut | 2–(3) | 1–2 | 1–2 | 1–2 |
| | acid weight loss | 4 | 4.1 | 4 | 4 |
| 10 | smut | 2–3 | 2–(3) | 2 | 2 |
| | acid weight loss | 2.1 | 1.8 | 1.5 | 1.5 |
| 15 | smut | 2–3 | 2–3 | 2–3 | 2–3 |
| | acid weight loss | 1.9 | 1.7 | 2.2 | 2.2 |
| 20 | smut | (2)–3 | 2–3 | 2–3 | 2–3 |
| | acid weight loss | 4.9 | 4.9 | 5.5 | 5.5 |
| 25 | smut | 3* | (2)–3 | (2)–3 | (2)–3 |
| | acid weight loss | 4.5 | 5.4 | 5.7 | 5.7 |
| 30 | smut | 2 | 3* | 3* | 3* |
| | acid weight loss | 3.6 | 4.2 | 4.4 | 4.4 |
| 35 | smut | 2–(3) | 2–(3) | 2–(3) | 2–(3) |
| | acid weight loss | 4.9 | 4 | 4.6 | 4.6 |
| 40 | smut | 2–3 | 2–3 | 2–3 | 2–3 |
| | acid weight loss | 5.2 | 4.1 | 4.2 | 4.2 |
| 45 | smut | (2)–3 | 2–3 | 2–3 | 2–3 |
| | acid weight loss | 3.7 | 3.6 | 4.3 | 4.3 |
| 50 | smut | (2)–3 | 2–3 | 2–3 | 2–3 |
| | acid weight loss | 3.1 | 3 | 3.1 | 3.1 |
| 55 | smut | (2)–3 | 2–3 | 2–3 | 2–3 |
| | acid weight loss | 3.5 | 2.9 | 2.9 | 2.9 |
| 60 | smut | 3* | (2)–3 | 2–3 | 2–3 |
| | acid weight loss | 2.9 | 4.2 | 4.9 | 4.9 |
| 65 | smut | 2–3 | 3* | 3–4* | 3–4* |
| | acid weight loss | 7.5 | 4.2 | 5.6 | 5.6 |
| 70 | smut | 2–3 | 2–(3) | 2–(3) | 2–(3) |
| | acid weight loss | 3.8 | 3.8 | 4.3 | 4.3 |

TABLE 6-continued

| $dm^2$ | property | Ex. 7 | Ex. 8 | Ex. 9 | Ex. 10 |
|---|---|---|---|---|---|
| 75 | smut | 2–3 | 2–3 | 2–(3) | 2–(3) |
| | acid weight loss | 4.3 | 4.9 | 4.7 | 4.7 |
| 80 | smut | 2–3 | 2–3 | 2–3 | 2–3 |
| | acid weight loss | 4.7 | 4.4 | 3.8 | 3.8 |
| 85 | smut | 2–3 | 2–3 | 2–3 | 2–3 |
| | acid weight loss | 4.8 | 3.9 | 5.3 | 5.3 |

The compositions of Examples 7 to 10, 85 $dm^2$ could be sealed in high quality with only two reinforcing additions.

TABLE 7

| $dm^2$ | property | Ex. 16 | Ex. 11 |
|---|---|---|---|
| 2 | smut | 2 | 2–3 |
| | acid weight loss | 7.0 | 5.3 |
| 5 | smut | (1)–2 | (1)–2 |
| | acid weight loss | 6.6 | 4.9 |
| 10 | smut | 2 | 2–3 |
| | acid weight loss | 4.3 | 3.6 |
| 15 | smut | 2 | 2–3 |
| | acid weight loss | 4.8 | 4.8 |
| 20 | smut | 2–3 | (2)–3 |
| | acid weight loss | 5.4 | 3.6 |
| 25 | smut | 3–4* | (2)–3 |
| | acid weight loss | 4.5 | 4.5 |
| 30 | smut | 2 | 3* |
| | acid weight loss | 4.8 | 5.0 |
| 35 | smut | 2 | 2–3 |
| | acid weight loss | 3.5 | 3.7 |
| 40 | smut | 3* | 2–3 |
| | acid weight loss | 3.0 | 3.5 |
| 45 | smut | 2 | 1–2 |
| | acid weight loss | 4.8 | 3.8 |
| 50 | smut | 2–(3) | 2 |
| | acid weight loss | 4.6 | 3.6 |
| 55 | smut | 2–3 | 2–(3) |
| | acid weight loss | 3.8 | 4.4 |
| 60 | smut | 3* | 2–3 |
| | acid weight loss | 4.2 | 4.3 |
| 65 | smut | 2 | 3* |
| | acid weight loss | 6.4 | 5.6 |
| 70 | smut | 2–(3) | 2 |
| | acid weight loss | 6.4 | 5.7 |
| 75 | smut | (2)–3 | 2 |
| | acid weight loss | 4.0 | 4.2 |
| 80 | smut | 2 | 2–3 |
| | acid weight loss | 3.5 | 3.7 |

For Example 16 three reinforcing additions were necessary as compared to only one for Example 11; the sealing quality (first bath and average) achieved with the composition of Example 11 was higher than the one achieved with Example 16.

TABLE 8

| $dm^2$ | property | Ex. 17 | Ex. 13 | Ex. 12 |
|---|---|---|---|---|
| 4 | smut | 1–2 | 1 | 1–2 |
| | acid weight loss | 5.6 | 7.0 | 5.8 |
| 9 | smut | 2–3 | 2–3 | 2 |
| | acid weight loss | 6.7 | 10.7 | 6.1 |
| 14 | smut | 3 | 2 | 2–3 |
| | acid weight loss | 2.4 | 6.2 | 2.1 |
| 19 | smut | 4* | 2 | (2)–3 |
| | acid weight loss | 2.7 | 4.6 | 2.8 |
| 24 | smut | 2–3 | 2 | 3 |
| | acid weight loss | 2.7 | 4.6 | 2.7 |
| 29 | smut | 3–4* | 2–3 | 2 |
| | acid weight loss | 2.4 | 4.0 | 3.2 |

TABLE 8-continued

| $dm^2$ | property | Ex. 17 | Ex. 13 | Ex. 12 |
|---|---|---|---|---|
| 34 | smut | 3* | 3–4* | 3* |
| | acid weight loss | 4.7 | 4.7 | 4.1 |
| 39 | smut | 2–3 | 2–3 | 2 |
| | acid weight loss | 3.9 | 6.3 | 3.5 |

From the comparison of Examples 12 and 17 results that for the composition of Example 17 three reinforcing additions were necessary for 39 $dm^2$, while for the composition of Example 12 only one was sufficient. From the comparison of Examples 12 and 13 results that the sealing quality achieved with the composition of Example 13 was much inferior to the one obtained with the composition of Example 12, on average and in each bath.

I claim:

1. An aqueous sealant composition comprising a solution of Components (a) at least one compound of formula (Ia)

(Ia)

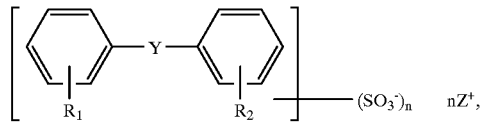

in which

Y is a direct bond or a bridging atom or group of formula —O—, —S—, —$C(CH_3)_2$—, —SO— or —$SO_2$—;

each of $R_1$ and $R_2$ is independently hydrogen or $C_5$–$C_{25}$-alkyl, with the proviso that $R_1$ and $R_2$ are not both hydrogen;

n is 1 to 4, inclusive;

and $Z^+$ is a monovalent counterion, and (b) a condensation product of an aldehyde and at least one compound having the following formula (IIb) or (IIIb)

(IIb)

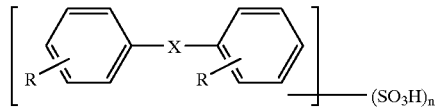

(IIIb)

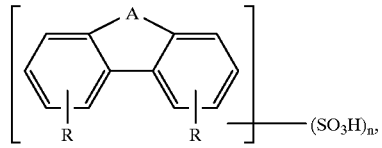

in which

X is a direct bond, —$C(CH_3)_2$—, —O—, —S—, —SO— or —$SO_2$—;

A is —O— or —S—;

each

R independently, is hydrogen, $C_{1-4}$-alkyl, hydroxy or halogen;

and n is 1 to 4.

2. A sealant composition according to claim 1, wherein Component (a) is at least one compound of formula (Ia')

(Ia')

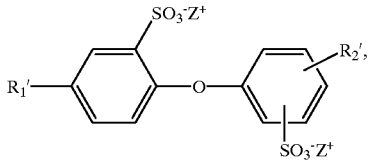

in which $R_1'$ is linear $C_{12}$- or $C_{16}$-alkyl, $R_2'$ is hydrogen or has the same significance as $R_1'$ (i.e. linear $C_{12}$- or $C_{16}$-alkyl) which alkyl group is in para position to —O—, and $—SO_3^-Z^+$ is in ortho position to —O— or, if $R_2'$ is hydrogen, the group $—SO_3^-Z^+$ may also be in para position to —O—.

3. A sealant composition according to claim 1, wherein the Component (b) is a condensation product of formaldehyde and at least one compound of formula (IIb')

(IIb')

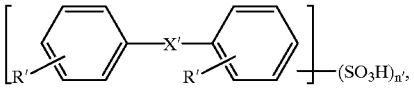

in which X' is —O—, n' is 1 to 2 and R' is methyl positioned in ortho and/or para to X'.

4. A sealant composition according to claim 1, wherein Component (a) and Component (b), referred to as compound of formula (IIb) and/or (IIIb), are in a molar ratio of about 1:10 to 5:1.

5. A sealant composition according to claim 1, wherein the weight ratio of Component (a) to Component (b) is in the range of 0.15:1 to 10:1.

6. A sealant composition according to claim 5, wherein the weight ratio of Component (a) to Component (b) is in the range of 1:1 to 2:1.

7. A process for sealing an aluminium oxide surface which comprises immersing the surface in an aqueous sealant composition at a temperature of about 70° C. to 100° C., said sealant composition comprising Components (a) and (b) as defined in claim 1.

8. A process according to claim 7 wherein the sealant composition comprises about 120–500 g/l in total of Components (a) and (b).

9. An aluminum oxide film which has been sealed by the process according to claim 8.

10. An aqueous sealant composition according to claim 1 which is a concentrate comprising about 120–500 g/l in total of Components (a) and (b).

11. An aqueous sealant composition according to claim 1 wherein $Z^+$ is selected from $H^+$ and/or an alkali metal ion and/or ammonium.

* * * * *